United States Patent [19]

Delamare

[11] 4,359,959

[45] Nov. 23, 1982

[54] DEVICE FOR MOORING A FLOATING INSTALLATION TO AN ANCHORED OFFSHORE INSTALLATION

[75] Inventor: Guy R. Delamare, Herblay, France

[73] Assignee: Institut Francais du Petrole, Rueil-Malmaison, France

[21] Appl. No.: 117,144

[22] Filed: Jan. 30, 1980

[51] Int. Cl.[3] ..... B63B 21/52

[52] U.S. Cl. ..... 114/230; 441/5

[58] Field of Search ..... 114/215, 220, 230; 9/8 P; 441/1, 3–5

[56] References Cited

U.S. PATENT DOCUMENTS

| | | | |
|---|---|---|---|
| 3,067,716 | 12/1962 | Norlin | 114/230 |
| 3,077,615 | 2/1963 | Schultz | 114/230 X |
| 3,440,671 | 4/1969 | Smulders | 114/230 |
| 4,088,089 | 5/1978 | Flory | 114/230 |

*Primary Examiner*—Trygve M. Blix
*Assistant Examiner*—Stephen P. Avila
*Attorney, Agent, or Firm*—Millen & White

[57] ABSTRACT

The device is made up of a connecting arm provided with rollers which bears on a cylindrical portion of the outer wall of the anchored offshore installation. Belts encircling this installation and the rollers are stretched to press these rollers against the cylindrical surface and permit rotation of the arm relative to the offshore installation.

8 Claims, 11 Drawing Figures

DEVICE FOR MOORING A FLOATING INSTALLATION TO AN ANCHORED OFFSHORE INSTALLATION

BACKGROUND OF THE INVENTION

The present invention relates to a device for mooring a floating installation to an offshore installation having a substantially stationary position relative to the water bottom.

The floating installation may be a ship and the offshore installation a mooring buoy located at some distance from the shore.

The offshore installation may also be a buoy for loading and/or unloading the cargo of a ship or installation wherefrom are performed or controlled such operations as drilling the sea bottom, recovering oil products, or alternatively a buoy, a floating caisson a tank, etc.

These type of systems are already known for mooring a ship to a structure such as a buoyant caisson, or to an oscillating riser pipe, by means of pivoting arms.

Such systems are, for example, described in the French Pat. No. 1,403,493 and the U.S. Pat. Nos. 3,354,479 and 3,908,212.

In such systems, the mooring structure is surmounted by a rigid arm integral with the ship in the extension of its stem on which it is articulated so as to accomodate pitching movements. To permit rotation of the arm and of the ship about the vertical axis of the mooring structure the arm is connected to this structure by means of a pivot provided with ball bearings or roller bearings, this pivot making up a rotary table or orientation ring.

Such prior devices suffer from many drawbacks with regard to resistance, reliability and constructional yield.

First such rotary tables which are very sensitive to marine corrosion are, like all roll bearings, designed for fast rotation and for successive and similar operation of all their parts. Moreover, they are poorly adapted to solve the problem of slow and occasional rotation where alternating forces developed by swells are exerted most of the time without substantial rotation of the table.

Since the prevailing winds statistically preferentially maintain the ship in one heading and consequently the connecting arm, the same area of the rotary table and thus, the same balls of the bearing are permanently maintained under load.

This mode of operation requires such an oversizing of these parts as to cause problems at the present time in the construction of large installations.

Moreover, in such a device loads of generally very high values are concentrated by the rotary table at the level of the central part of the upper platform of the mooring structure. This requires extensive reinforcements for the purpose of distributing all these loads over the entire structure.

SUMMARY OF THE INVENTION

The main object of the present invention is to provide a new rotary device which permits permanent mooring of a ship to an installation connected to a stationary point of the water bottom, this device being more reliable, more resistant and offering a higher constructional yield than the devices used before, and moreover, being usable irrespective of the size of the installations.

BRIEF DESCRIPTION OF THE DRAWINGS

The characteristics and advantages of this invention will be made more readily apparent from the following description of some embodiments illustrated by the accompanying drawings, wherein.

DETAILED DISCUSSION OF THE INVENTION

Figure 1:
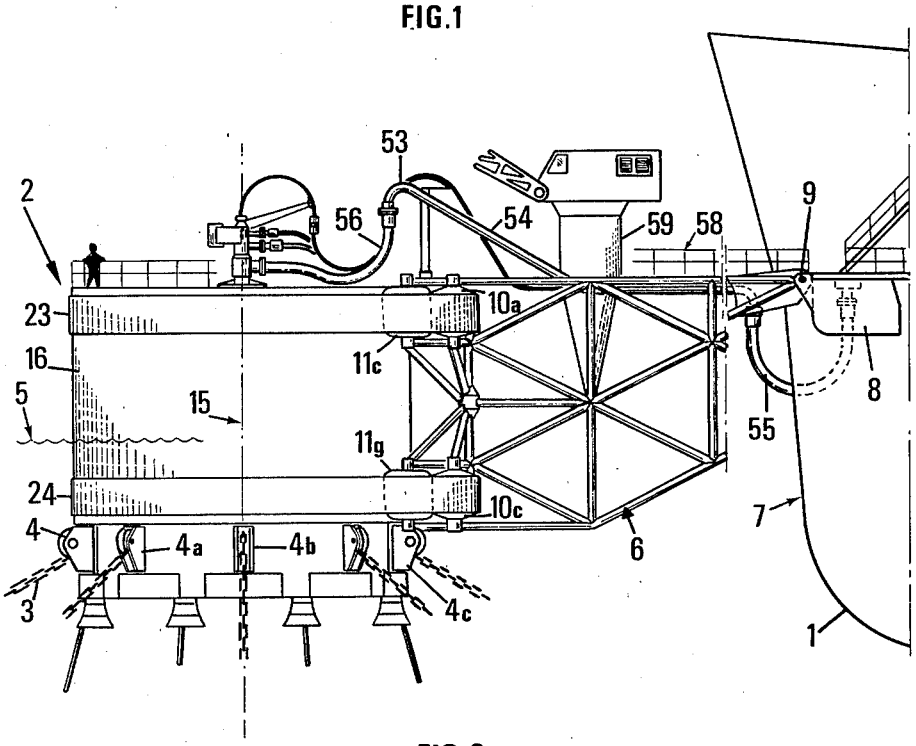
FIG. 1 is a front view of a first embodiment of the invention.
Figure 2:
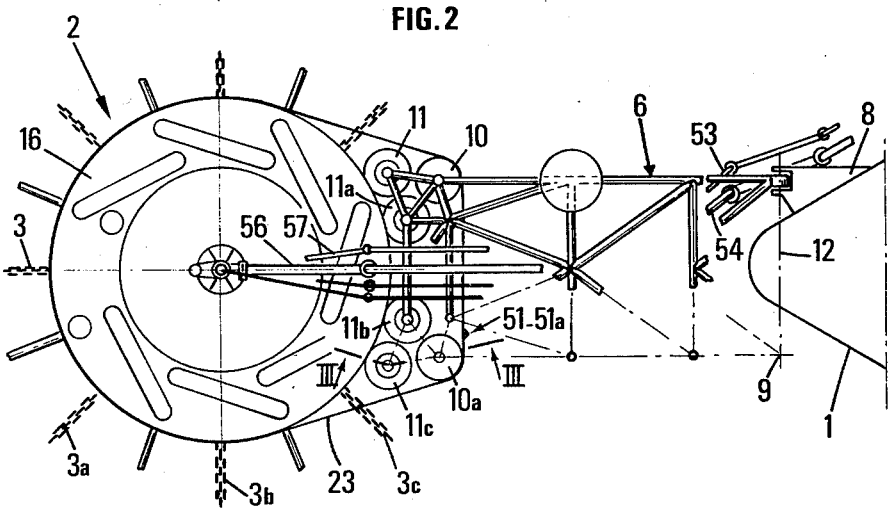
FIG. 2 is a top view of the embodiment of FIG. 1.
Figure 3:
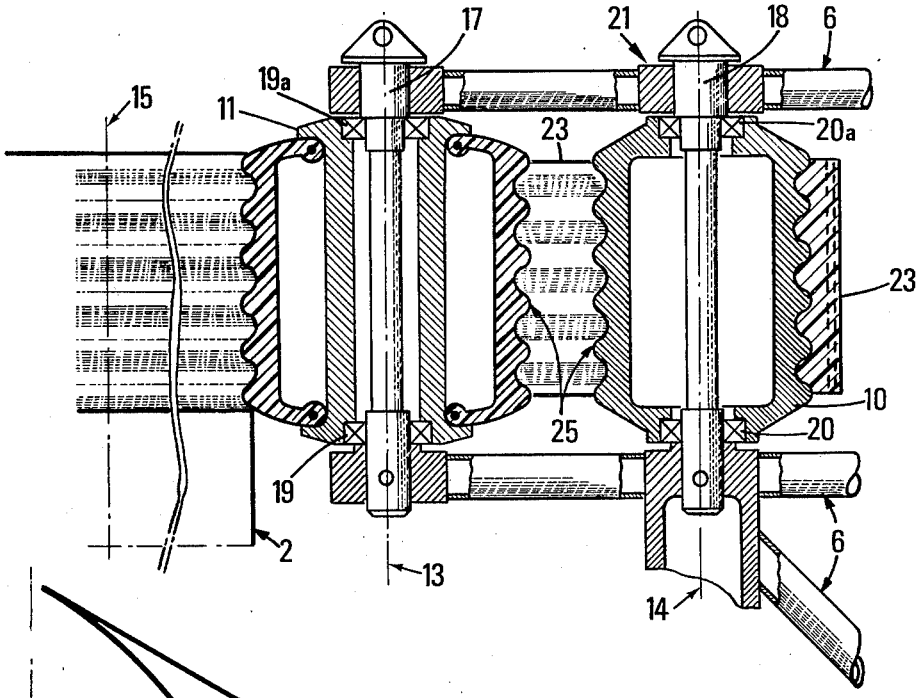
FIG. 3 is a cross-sectional view along line III of FIG. 2.

FIGS. 1, 2 and 3 show a first embodiment of the mooring device, according to the invention, for mooring a floating installation 1, such as a ship, to an offshore installation 2, such as a floating buoy of cylindrical shape connected to the water bottom by means of wire line moorings 3, **3*a*, 3*b*, 3*c* . . . and mooring chocks 4, 4*a*, 4*b*, 4*c*** . . . .

The water level is diagrammatically indicated by line of FIG. 1.

The device comprises a rigid connecting arm 6 which is, for example, of cross-braced tubular structure. This arm is in the extension of the stem 7 of the ship and is articulated by means of bearings 9, at the level of its connection to the stem 7 which is reinforced by iron fittings 8, about the horizontal axis 12 perpendicular to the longitudinal symmetry plane of the ship.

At its end opposite to the articulation 9, the arm 6 carries at a first level two idle pulleys 10 and **10*a* and four wheels 11, 11*a*, 11*b* and, 11*c*** equipped with tires.

Similarly, at a second level, two idle pulleys **10*b* and 10*c* and four wheels 11*d*, 11*e*, 11*f*, 11*g* equipped with tires are carried by the arm 6. The axes of rotation, such as 13 and 14 (FIG. 3) of the pulleys and wheels are held parallel to the vertical axis 15 of the cylindrical buoy 2 when the treads of these wheels contact the outer wall 16** of the buoy.

Each shaft, such as the shafts 17 and 18, carrying the roll bearings, such as 19 and **19*a* of the wheels and 20 and 20*a* of the pulleys, connects two junction knots, for example 21 and 22, of the tubes of the cross-braced structure forming the connecting arm 6**.

The eight wheels 11 through **11*g* are held in contact with the wheel 16 of the buoy 2 by means of two straps or flexible belts forming closed loops which encircle, at each level, both the idle pulleys and the outer wall of the buoy. The upper belt 23 is stretched or tensioned by the pulleys 10 and 10*a* and the lower belt 24 is stretched by the pulleys 10*b* and 10*c***.

The tubes which form the cross-braced structure of the arm 6, as well as the wheels and pulleys carried by this arm are preferably closed watertight chambers. The assembly made up of the arm 6, the wheels 11 through 11*g*, and the pulleys 10 to 10*c* preferably have a positive buoyancy so that this assembly floats without pressing substantially on the contact area of the wheels with the outer wall of the buoy. Advantageously, the contact surfaces of the belt, of the buoy and of the pulleys on one side, and the contact surfaces of the wheels and of the buoy on the other side, will have complementary shapes whereby an accurate relative positioning of these elements can be maintained. For example, as shown at 25 in FIG. 3 these surfaces can have horizontally extending corrugations. Moreover, such corrugations can also extend vertically or can be inclined to the vertical. The operation of this system is described below.

The tires of the wheels 11 through 11*g* being deflated, the arm 6 is moved toward the buoy 2 until the wheels contact the outer surface 16 of this buoy. The belts 23 and 24 are then brought into position. The tyres of the wheels 11 to 11*g* are inflated, thereby stretching the belts 23 and 24 by means of the pulleys 10 through 10*c*. The connecting arm 6 will thus follow the pitch and roll movements of the buoy. On the other hand, the arm can pivot about the vertical axis of the buoy. This pivoting movement is permitted both by the wheels 11 through 11*g* rolling along the lateral wall 16 of the buoy, and by the belts 23 and 24 which are moved apart as the arm 6 is rotated, thus leaving a passage for the idle pulleys 10 and 10*c* which roll along the internal surface of the belts during their rotation.

When, under the combined action of the wind, water current and waves, the ship 1 is subjected to a horizontal drag, the horizontal drag produces a traction force which is transmitted, through the arm 6, to the bearings of the pulleys 10 through 10*c* and thus stretches the two belts 23 and 24 which are held by the anchored buoy 2 on the lateral wall onto which they are pressed over a large area.

When, under the orbital movements of the swells, the ship 1 is subjected to a pounding movement, any displacement of this ship toward the buoy 2 is stopped by the wheels 11 through 11*g* bearing against the lateral wall of the buoy, thus resulting in a compression of the tires.

When the direction of the wind, water current or waves vary, the ship 1 pivots like a weatherwave about the axis of the buoy, as above described, and takes a new position.

When, under the action of a swell directed along the longitudinal axis of the ship, the latter and the buoy are subjected to pounding movements and pitch which create great differences in the level between them, the assembly of the arm 6 and of the buoy 2 oscillates about the axis 12 of the point of articulation 9. Depending on its orientation, the torque developed by the arm 6 connected to the buoy 2 puts the upper belt 23 under tension thereby producing a compression of the tires of the lower wheels 11*d*, 11*e*, 11*f* and 11*g* against the lower part 16 of the buoy, or stretches the lower belt 24 producing a simultaneous compression of the tires of the upper wheels 11, 11*a*, 11*b*, and 11*c* against the upper part of the wall 16 of the buoy. In this case, the shear force at the level of the connection between the arm and the buoy is transmitted by adherence of the tires of the wheels or through mutual shearing of the side walls of the corrugations 25 of the outer surface of these tires.

When the ship moves to a position with its head to the wind, the transverse swell produces a rolling of the ship. A torque is induced in the arm 6 through the bearing 9 and transmitted to the buoy by adherence of the tires of the wheels 11 through 11*g* or through mutual shearing of the side walls of the corrugations 25 of the outer surface of these tires.

The torque and the shear stress resulting from the pitch movements can be more efficiently transmitted by selecting one of the embodiments illustrated in FIGS. 4, 4A, 5 and 5A.

Figure 4A:
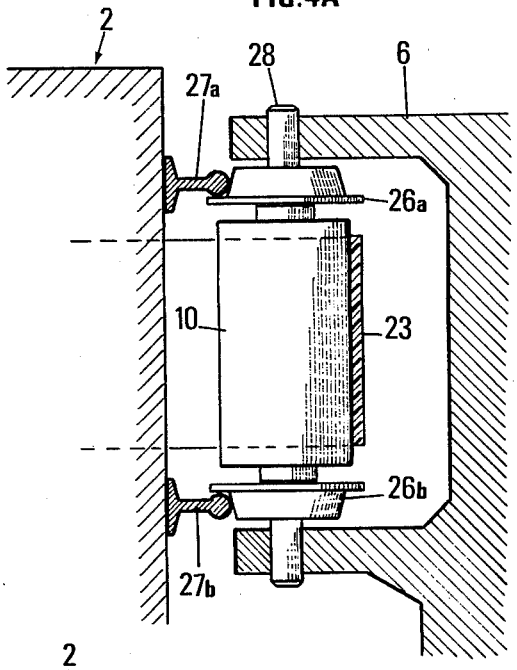
FIG. 4A is a cross-sectional view along line IV of FIG. 4.
Figure 4:
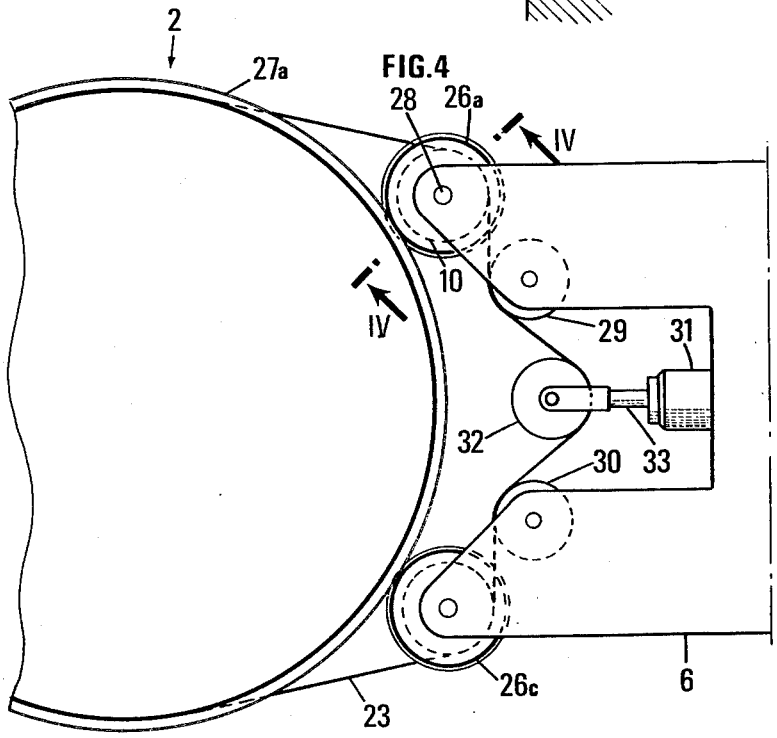
FIG. 4 is top view of a second embodiment of the connecting arm of the device.

In the embodiment illustrated in FIGS. 4 and 4A, use is made of profiled wheels 26*a*, 26*b*, 26*c* and 26*d* having the shape of tip truck wheels which co-operate with rails 27*a* and 27*b* integral with the buoy 2.

On the shafts 28 of the wheels 26*a*, 26*b*, 26*c* and 26*d* are journaled the pulleys 10 and 10*a* whereon passes the belt 23. Auxiliary pulleys 29 and 30 carried by the arm 6 provide for a sufficient contact length between the belt 23 and the pulleys 10 and 10*a*. A hydraulic or mechanical jack 31 secured to the arm 6 permits adjustment of the tension of belt 23 by displacing a pulley 32 secured to the end of the movable stem 33 of the jack.

Figure 5:
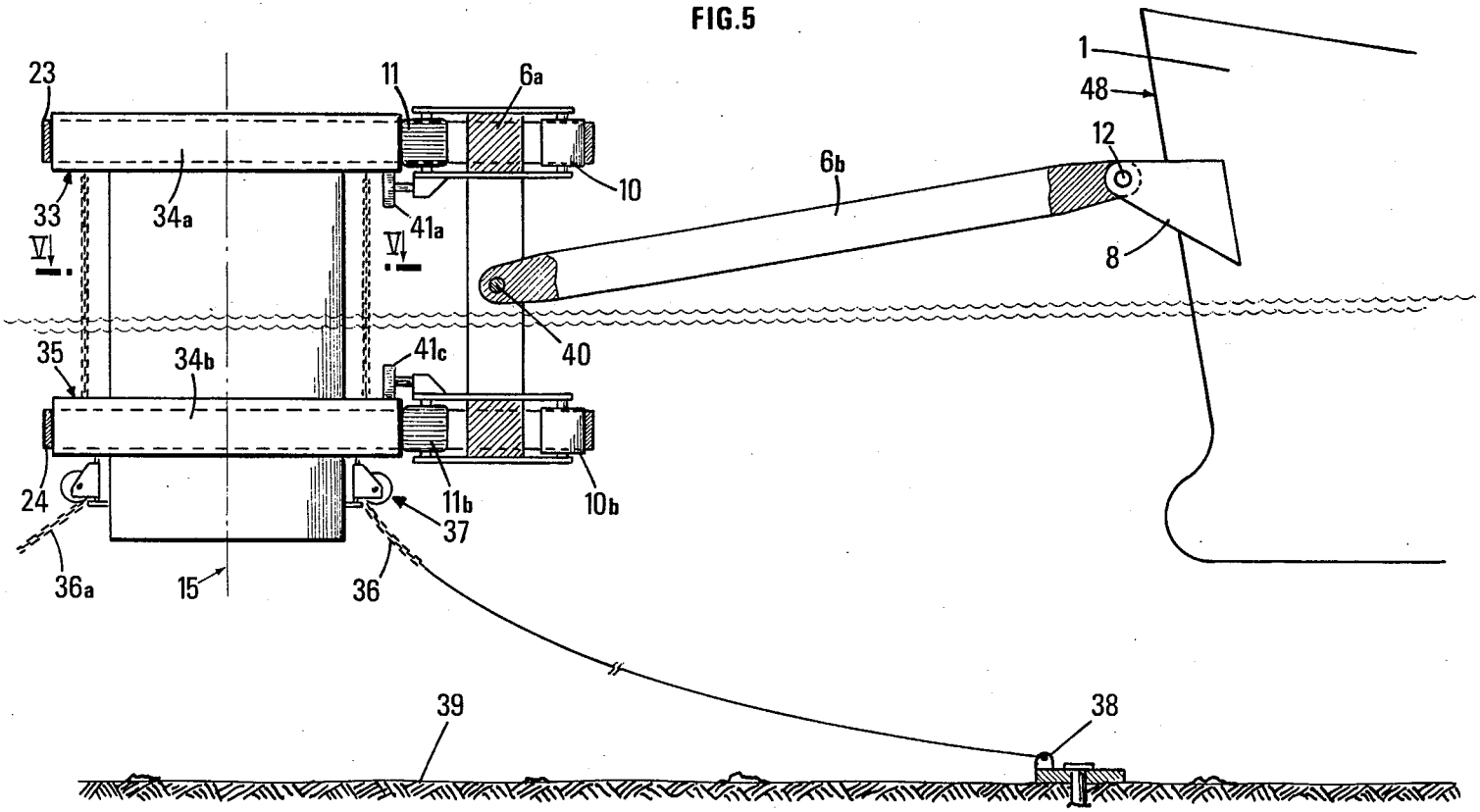
FIG. 5 illustrates a third embodiment of the rotary arm.
Figure 5A:
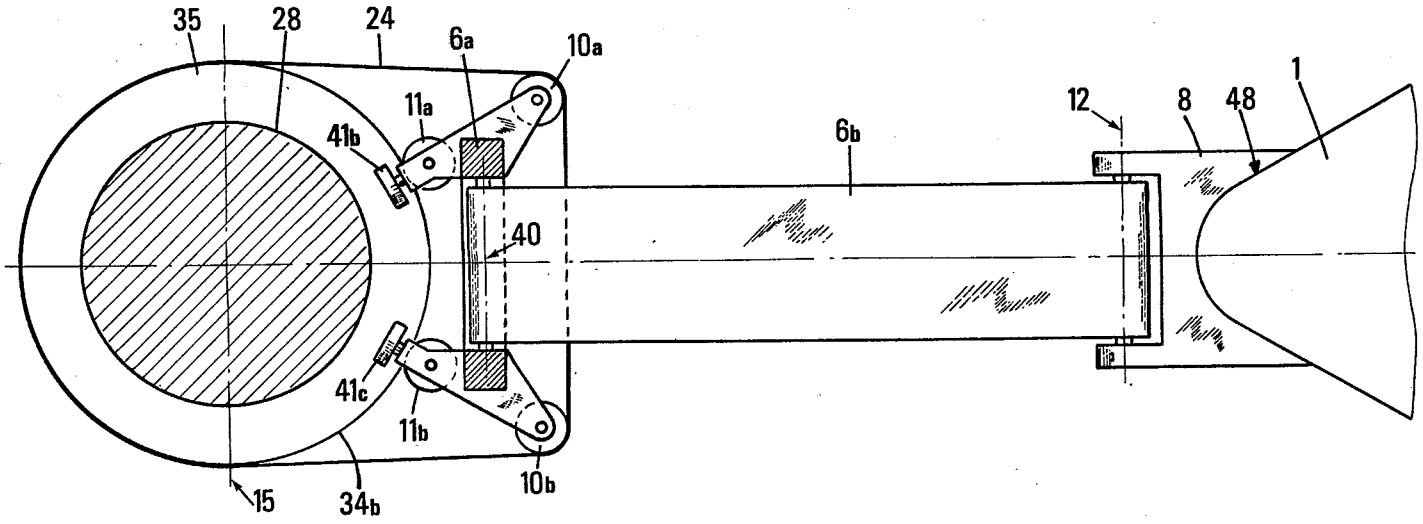
FIG. 5A is a cross-sectional view along line V of FIG. 5.

FIGS. 5 and 5*a* show another embodiment of the connecting arm 6 whereby the ship 1 can be moored to a floating column or riser pipe connected to the water bottom by means of the anchoring lines 36, 36*a*, etc., and through the intermediary of mooring chocks 37 and anchoring points 38 secured to the water bottom 39.

In this embodiment the arm 6 is made up of two separate elements 6*a* and 6*b* hingedly connected to each other on a shaft 40 parallel to the articulation axis 12. The first element 6*a* has the shape of a frame supporting the pulleys 10 and 10*a* for tensioning the belts 23 and 24, and supporting the wheels 11, 11*a* . . . .

The second element 6*b* is a beam hinged on the shaft 12 of the ship 1. The wheels 10, 10*a*, 10*b* . . . , and the belts 23 and 24 bear on the lateral wall of cylindrical flanges 34*a* and 34*b* inserted in the column 28 so as to provide ring-shaped flat rolling paths. Wheels 41, 41*a* and 41*b*, whose axes are radial with respect to the column 2, bear on the ring-shaped flat side walls of the cylindrical flanges 34*a* and 34*b* inserted at the periphery of the column 2.

Such an arrangement provides a high constructional yield. The forces generated by the connecting arm 6 are applied to the buoy or column 2 and distributed over a large contact area, so that low bearing pressures are exerted on a structure of cylindrical shape which is especially designed to withstand such compression loads without requiring excessive reinforcements. These loads, which are transmitted through the belts and the wheels at two levels substantially distant from each other enable the transmission of the embedding moment of the connecting arm to the buoy. These reaction forces at the location of the bearings are reduced as the length of the lever arm increases. Moreover, the elastic and plastic characteristics of the belts and of the wheels equipped with tires make it possible to dampen the loads developed by certain sudden impacts produced by the dynamic alternating actions of the swells.

Moreover, since the cylindrical columns 2 do not include any mechanical parts, they can be economically constructed such as by welding, without requiring precise tolerances or machining, and the connections by belts and tires are completely unaffected by marine corrosion, contrary to mechanisms using ball bearings.

Whenever required, should extreme meteorological-oceanographic conditions occur of such an amplitude that the installation, taken as a whole, cannot withstand them without damage, it is possible to rapidly disconnect the structural ship, so as to preserve the integrity of the buoy 2 and thus avoid deterioration of the installations and under water connections. To achieve such a fast separation between the buoy and the ship, it suffices to cut off the retaining belts, for example, at the location where the band forming each of these belts, as illustrated in FIG. 2, is folded on itself, by means of metal fittings 51 and 51*a* bolted to each other and which pinch the ends of this bend, this connection being destroyed by remotely actuating exploding bolts 52.

Figures 6A, 8:
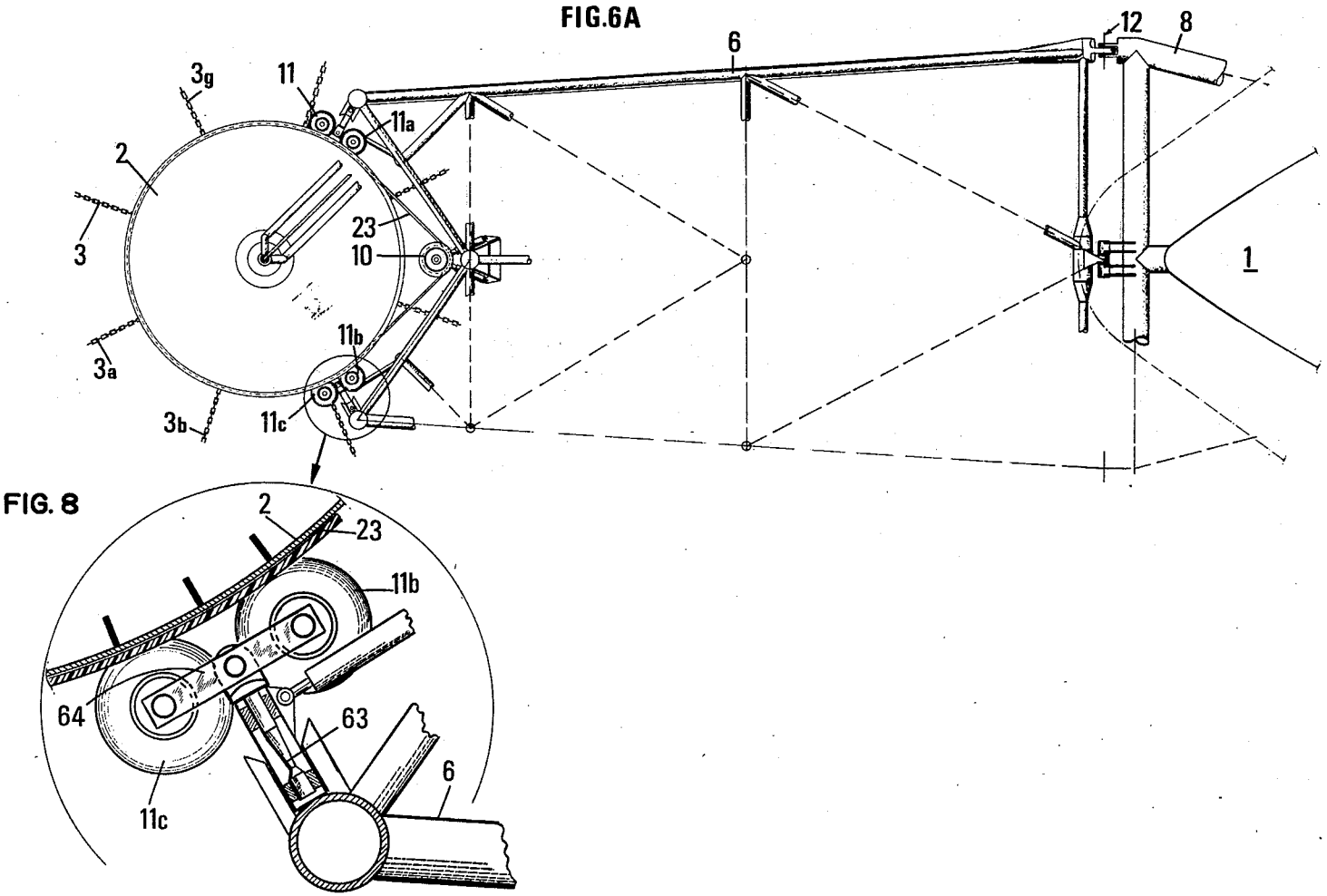
FIGS. 6A and 6B illustrate another embodiment of the device.
FIG. 8 is an enlarged view of the circled portion of FIG. 6A.
Figure 6B:
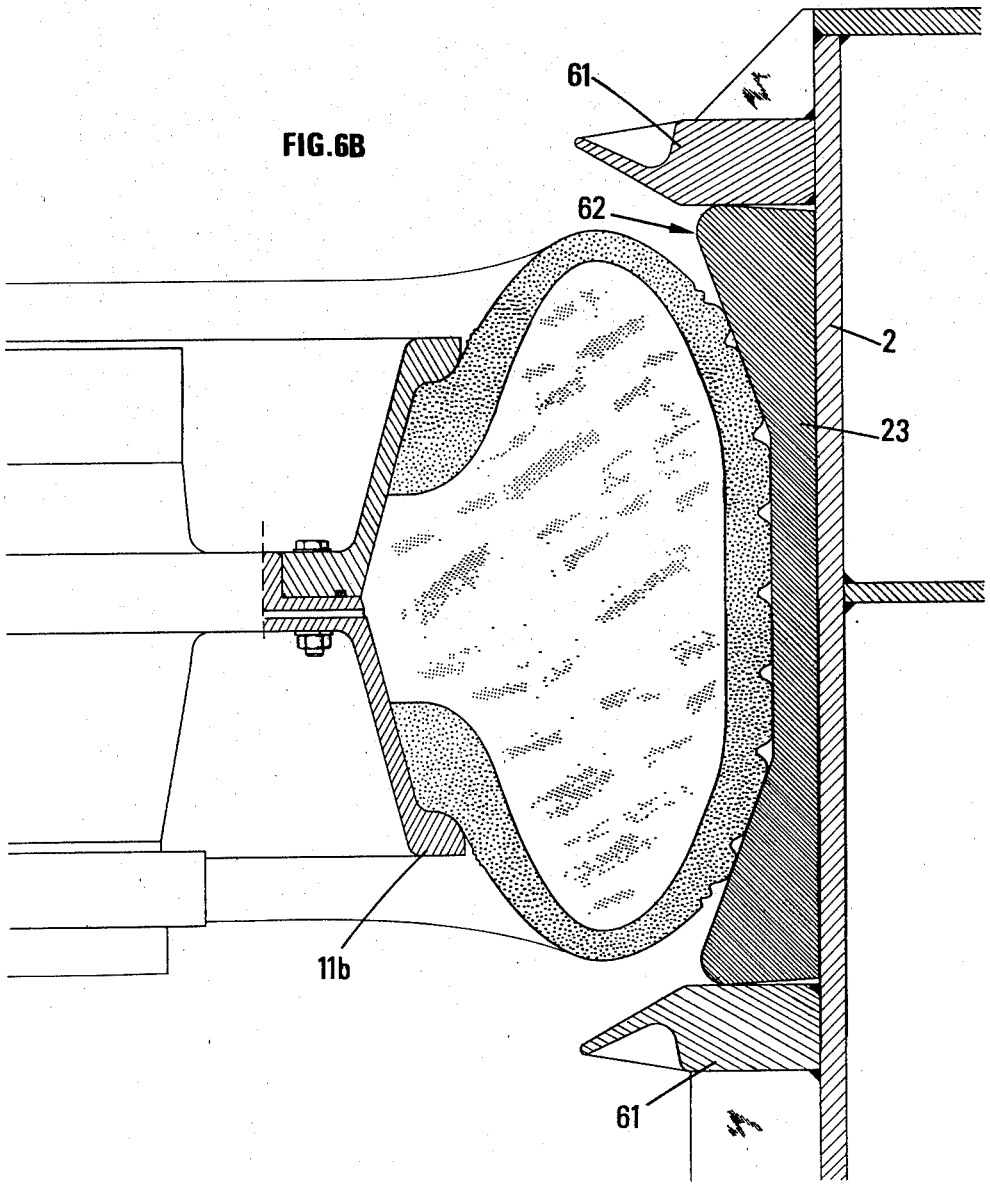

FIGS. 6A and 6B illustrate an alternative embodiment of the invention. In this embodiment relative sliding of the belts 23 and 24 and the buoy 2, in a direction parallel to the axis of the buoy 2 is prevented by positioning the belts in grooves provided on the buoy 2. These grooves are, for example, defined by the vertical wall of the buoy and by flanges 61 integral therewith. Moreover shear stresses at the level of the connection between the arm and the buoy are transmitted through the belts.

In fact, as apparent in FIG. 6B the outer surface 62 of each belt, opposite to its contact area with the cylindrical surface of the buoy 2, has a concave section. This outer surface constitutes a rolling path for the roller means whose wheels are equipped with tires having a convex other surface substantially complementary to the outer surface 62 of the belts.

To ensure appropriate rolling of the roller means on the belts, each wheel assembly is carried by a support member articulated about a shaft 63 radial with respect to the buoy 2 in a plane parallel to the axis 12.

Changes may be made without departing from the scope of the present invention. For example, although the drawings illustrate the anchoring of a ship to a surface buoy, it is possible to use other offshore equipment, such as a tower, provided such equipment has an outer cylindrical wall over at least a portion of its length.

Figure 7:
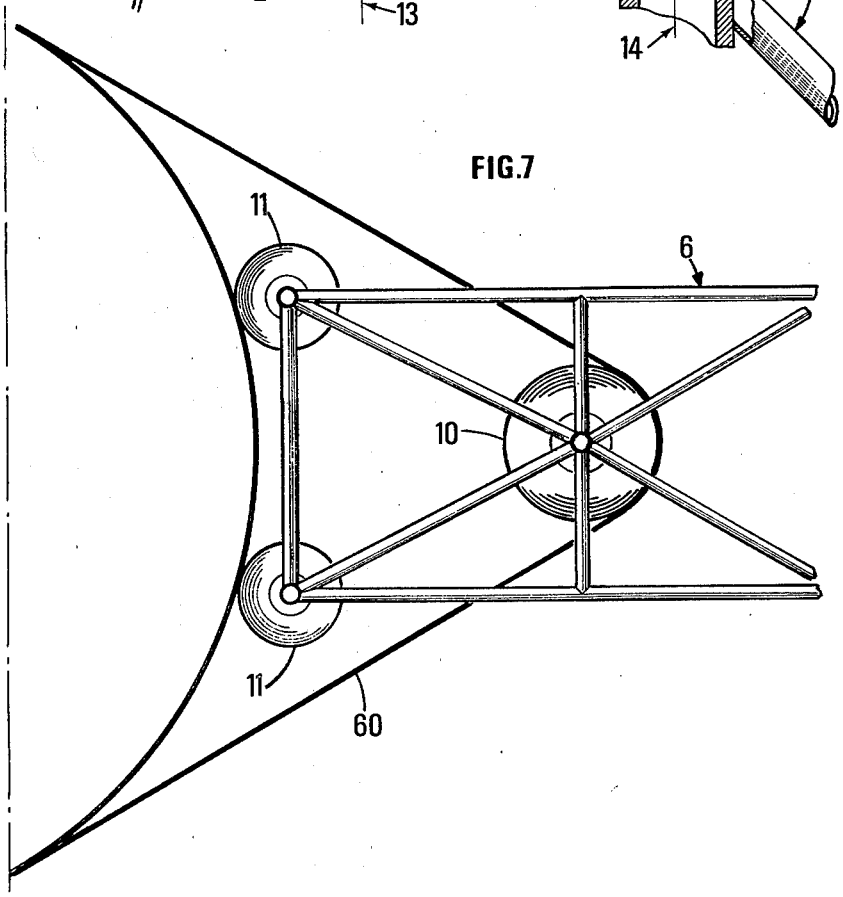
FIG. 7 shows an alternative embodiment of the invention.

The number of wheels and pulleys may be different from that illustrated. For example, as diagrammatically shown in FIG. 7, for each belt 60 a single pulley 10 may be associated with two wheels 11, these three rotary elements being placed at the apices of a triangle.

Moreover the number of belts can vary and will be determined by those skilled in the art in dependence on the loads to be supported by the device, provided the belts properly maintain in contact with each other the wheels and the rolling path thereof on the marine installation 2.

It is also possible to replace the floating buoy 2 with a buoy submerged at greater or lesser depth, the arm 6 being of corresponding shape and suitably ballasted.

The belts may be constructed in a known manner. They may be made, for example, of a plastic or resilient material reinforced with wire layers, strips, or strands or with layers of braided wires.

Such reinforcements for withstanding the mechanical loads applied to the belts may be made of metal, glass fibers, or plastic fibers, such as those sold under the registered trade mark KEVLAR, etc.

The belts may also be formed of cables or chains.

All the above embodiments of the invention are only indicated by way of example.

The above-described various technological solutions may be combined to each other in different manners so as to solve the overall problem arising from a particular application to a given case.

The rotary device according to the invention for mooring a ship to a cylindrical buoy is particularly suitable in the construction of installations for temporary production of oil from an underwater oil well where the anchored buoy supports the flexible pipes 63 connecting the underwater well-heads to the water surface, and wherein the ship is a tanker equipped with production processing means.

For this purpose, as illustrated in FIGS. 1 and 2, and tubular structure of the arm supports the rigid pipes 53, 54 . . . for conveying the fluid, these pipes being connected to flexible pipes 55, 56, 57 . . . connected in turn to the pipings equipping the ship and the buoy.

The tubular structure of the arm may also be equipped with gangways 58 permitting passage of the maintenance personnel between the ship and the buoy, and by a crane for unloading equipment on the buoy.

What is claimed is:

1. A device for mooring a floating installation to an offshore structure of positive buoyancy connected to a stationary point of the water bottom, the offshore structure of positive buoyancy having over at least a portion of its length a cylindrical outer surface of vertical axis, the device comprising:

a rigid connecting arm articulated to the floating installation about a substantially horizontal axis;

roller means provided on said rigid connecting arm, said roller means comprising at least one assembly of at least two substantially coplanar wheels having axes of rotation substantially orthogonal to the axis of articulation of said connecting arm, each one of said at least two wheels located on each side of the longitudinal axis of said connecting arm; and coupling means for maintaining said roller means in contact with said offshore structure of positive buoyancy on a rolling path carried on said offshore structure of positive buoyancy, for permitting relative rotation of said connecting arm and said offshore structure of positive buoyancy about the vertical axis, said coupling means comprising at least one pulley means carried by said connecting arm and having an axis of rotation parallel to the axes of rotation of said wheels, at least one belt means passing around said pulley means and said offshore structure of positive buoyancy, and stretching means for stretching said belt means.

2. A device for mooring a floating installation to an offshore structure of positive buoyancy connected to a stationary point of the water bottom, the offshore structure of positive buoyancy having over at least a portion of its length a cylindrical outer surface of vertical axis, the device comprising:

a rigid connecting arm articulated to the floating installation about a substantially horizontal axis;

roller means provided on said rigid connecting arm, said roller means comprising at least two assemblies of at least two substantially coplanar wheels having axes of rotation substantially orthogonal to the axis of articulation of said connecting arm, said at least two assemblies being located at separate levels of the offshore structure of positive buoyancy and at a distance from each other, and each one of said at least two wheels located on each side of the longitudinal axis of said connecting arm; and coupling means for maintaining said roller means in contact with said offshore structure of positive buoyancy on a rolling path carried on said offshore structure of positive buoyancy, for permitting relative rotation of said connecting arm and said offshore structure of positive buoyancy about the vertical axis, said coupling means comprising at least one pulley means carried by said connecting arm and having an axis of rotation parallel to the axes of rotation of said wheels, at least one belt means forming a closed loop passing around said pulley means and said offshore structure of positive buoyancy, and stretching means for stretching said belt means.

3. A device according to claim 2 or 1, wherein said wheels are equipped with tires which are inflated for stretching said belt means.

4. A device according to claim 2 or 1, wherein said rolling path is made up by the outer cylindrical wall of the offshore structure of positive buoyancy, the outer surface of the wheels and the cylindrical surface of the offshore structure of positive buoyancy have complementary shapes for preventing sliding of said surfaces relative to each other in a direction parallel to the vertical axis of the offshore structure of positive buoyancy, and the outer cylindrical wall of the offshore structure of positive buoyancy, the inner surface of the belt means, and the surface of the pulley means have complementary shapes.

5. A device according to claim 2 or 1, wherein said rolling paths are made up by rails secured to the offshore structure of positive buoyancy, the wheels and the rails having co-operating complementary shapes to permit relative rotation of the connecting arm and the offshore structure of positive buoyancy, said stretching means for stretching the belt means comprising a movable pulley means carried by the connecting arm and in contact with said belt means.

6. A device according to claim 2 or 1, wherein said connecting arm carries at least two guide wheels cooperating with flanges of the offshore structure of positive buoyancy to prevent relative displacement of the arm and the offshore structure of positive buoyancy in a direction parallel to the vertical axis of the marine installation.

7. A device according to claim 2 or 1, comprising the same number of pulley means and of belt means as the number of assemblies of coplanar wheels, the external wall of each belt means comprising a rolling path for an assembly of coplanar wheels, each belt means being maintained in a groove provided in said cylindrical portion of the offshore structure of positive buoyancy.

8. A device according to claim 7, wherein the external surface of the belt means, which is opposite to its surface in contact with the cylindrical wall of the offshore structure of positive buoyancy is concave and cooperates with the wheels' surface to prevent relative sliding of the arm and of the offshore structure of positive buoyancy in a direction parallel to the vertical axis of the latter.

* * * * *